United States Patent [19]

Otobe et al.

[11] 4,372,277

[45] Feb. 8, 1983

[54] EXHAUST GAS RECIRCULATION CONTROL SYSTEM

[75] Inventors: Yutaka Otobe, Niiza; Michio Kawamoto, Tokyo, both of Japan

[73] Assignee: Honda Giken Kogyo Kabushiki Kaisha, Tokyo, Japan

[21] Appl. No.: 254,991

[22] Filed: Apr. 16, 1981

[51] Int. Cl.[3] ..... F02M 25/06

[52] U.S. Cl. ..... 123/571; 123/568

[58] Field of Search ..... 123/568, 571

[56] References Cited

U.S. PATENT DOCUMENTS

| | | | |
|---|---|---|---|
| 4,033,308 | 7/1977 | Hayashi et al. | 123/119 |
| 4,235,207 | 11/1980 | Nishimura | 123/568 |
| 4,242,998 | 1/1981 | Shioya et al. | 123/568 |
| 4,249,504 | 2/1981 | Shioya et al. | 123/568 |

FOREIGN PATENT DOCUMENTS

| | | |
|---|---|---|
| 1486093 | 9/1977 | United Kingdom . |
| 1486651 | 9/1977 | United Kingdom . |

*Primary Examiner*—Wendell E. Burns

*Attorney, Agent, or Firm*—Lyon & Lyon

[57] ABSTRACT

A control valve in an exhaust gas recirculation line for an engine is operated by vacuum pressure from a regulating valve. The regulating valve has a vacuum chamber positioned between two orifices mounted in a line leading to atmospheric air intake. An air valve located downstream from said regulating valve and orifices controls vacuum pressure from a control suction air line leading to the engine intake passage. The return rate of exhaust gas to the engine is proportional to the flow rate of suction air supplied to the engine, thereby providing a desired exhaust gas return ratio.

2 Claims, 3 Drawing Figures

EXHAUST GAS RECIRCULATION CONTROL SYSTEM

This invention relates to an exhaust gas recirculation system for use in an engine, wherein an exhaust gas return line branching from the exhaust passage of the engine contains a control valve and leads to the intake passage of the engine. The control valve is operable to control the return rate of exhaust gas to the intake passage through a change in the vacuum pressure acting upon the control valve.

In a conventional automotive engine, it has already been put into practice to return part of exhaust gas emitted from the engine to the intake passage of the engine through an exhaust gas return line, in order to restrain an excessive increase in the combustion temperature of the air-fuel mixture as well as to minimize the production of nitrogen oxides which contribute to air contamination. If this method is employed, to effectively prevent the occurrence of nitrogen oxides, it is necessary to maintain the return rate of exhaust gas at a value proportional to the flow rate of suction air supplied to the engine, that is, to maintain at a constant value the ratio of the return rate of exhaust gas to the flow rate of suction air supplied to the engine (hereinafter called "exhaust gas return ratio"). In addition, it is a requisite that this exhaust gas return ratio can be readily set at any optional value in accordance with the performance characteristics, operating conditions, etc. of the engine.

The principal object of this invention is to provide a simple and effective exhaust gas recirculation system which can satisfy the above-mentioned requirements.

Embodiments of the present invention will now be described with reference to the drawings, which relate to an automotive engine.

Figure 1:
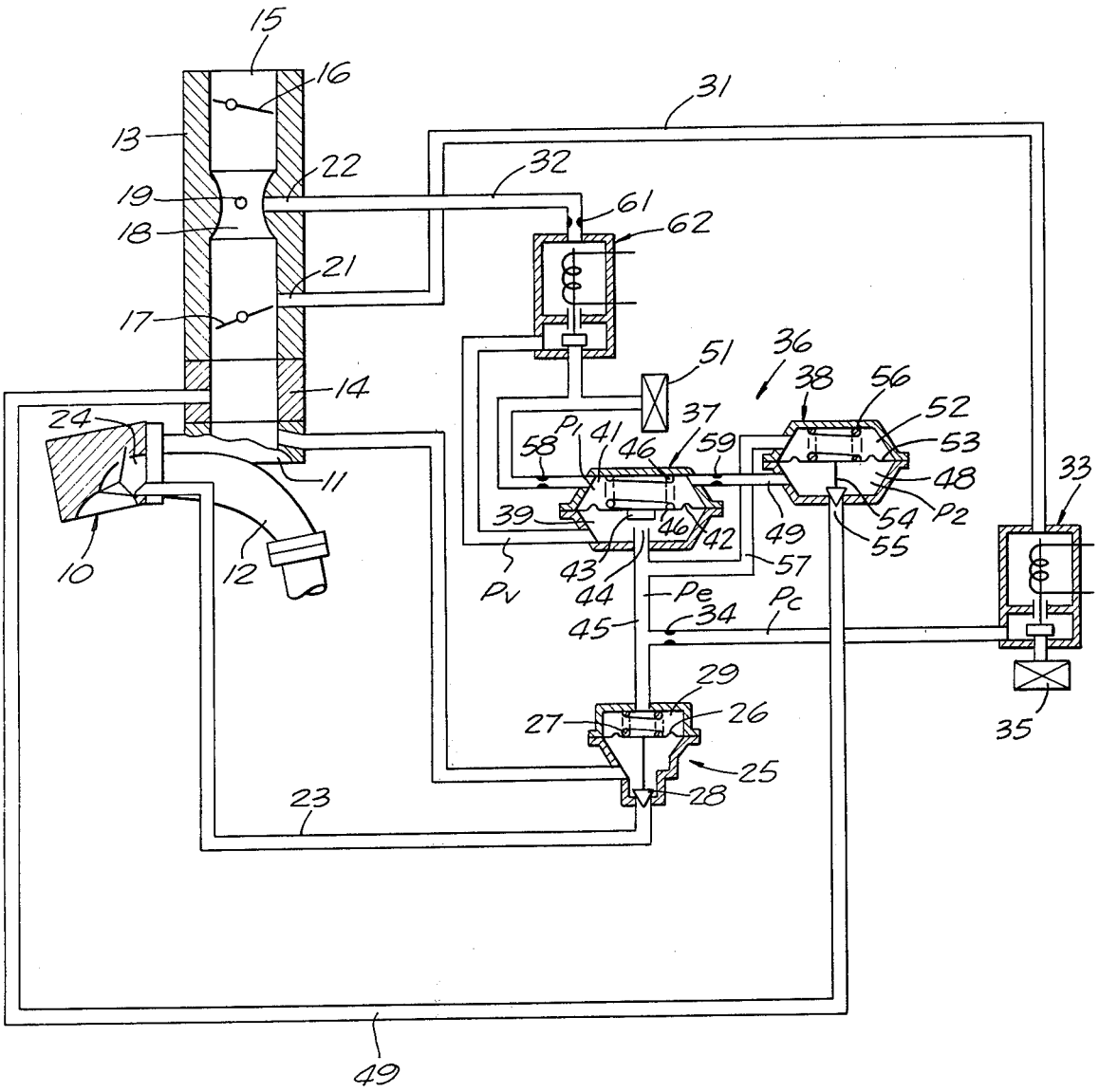
FIG. 1 is a schematic diagram showing a preferred embodiment of this invention.

Referring to the drawings, and particularly to FIG. 1, the engine 10 is provided with an intake manifold 11 and an exhaust manifold 12, the intake manifold 11 being provided with a carburetor 13 mounted on an insulating tube 14. The intake manifold 11, insulating tube 14 and carburetor 13 form the intake passage 15 of the engine 10. The carburetor 13 has a choke valve 16 and a throttle valve 17, both in the intake passage 15, with a venturi 18 between them. A fuel nozzle 19 opens into the venturi 18.

The intake passage 15 is provided with a first vacuum pressure detecting port 21 opening in the vicinity of the throttle valve 17 and a second vacuum pressure detecting port 22 opening into the venturi 18. The first vacuum pressure detecting port 21 is positioned on the upstream side of the throttle valve 17 when it is in an idle opening position and on the downstream side of same when the throttle valve 17 is opened.

Connected to the intake manifold 11 is an exhaust gas return line 23 which branches from the exhaust port 24 of the engine 10. Controlling flow through the exhaust gas return line 23 is a return control valve 25 which is operated by vacuum pressure against a diaphragm 26 opposed by a spring 27. A needle-type valve element 28 is fixed to move with the diaphragm 26. A vacuum pressure chamber 29 is formed on the upper side of the diaphragm 26, and the valve spring 27 urges the valve element 28 to move toward closed position.

Connected to the chamber 29 of the return control valve 25 are first and second vacuum pressure lines 31, 32 extending, respectively, from the first and second vacuum pressure detecting ports 21, 22. The first pressure line 31 is provided with a solenoid valve 33 and an orifice 34 in series with it. The solenoid valve 33 is adapted to shut off the upstream side of the vacuum pressure line 31 and communicate the downstream side of same with the atmospheric pressure inlet port 35 having a filter, when it is in an energized state.

The second vacuum pressure line 32 is provided with a control valve generally designated 36 which comprises a regulating valve 37 for opening or closing the second vacuum pressure line 32, and an air valve 38 for controlling the regulating valve 37 through feedback of vacuum pressure acting upon the return control valve 25.

The regulating valve 37 comprises a valve chamber 39 connected to the second vacuum pressure line 32, and a vacuum pressure chamber 41 formed adjacent the valve chamber 39 and partitioned therefrom by a diaphragm 42. A flat valve element 43 is secured on the diaphragm 42 for opening or closing a valve port 44 formed on the open end of pipe 45 which communicates with the first vacuum pressure line 32. A valve spring 46 acts to urge the valve element 43 to move in the valve closing direction.

The air valve 38 comprises a valve chamber 48 communicating with a control suction air line 49 extending from the intake passage 15 at a location downstream of the throttle valve 17 and leading to an atmospheric pressure inlet port 51 having a filter. A vacuum pressure chamber 52 is formed adjacent the valve chamber 48 and partitioned therefrom by a diaphragm 53. A valve element 54 is secured on the diaphragm 53 for adjusting the opening of a valve port 55 formed in the control suction air passage 49, and a valve spring 56 is arranged to urge the valve element 54 in the valve closing direction.

The valve element 54 of the air valve 38 has a configuration substantially similar to that of the valve element 28 of the return control valve 25. The vacuum pressure chamber 52 communicates with the valve port 44 of the regulating valve 37, that is, the vacuum pressure chamber 29 of the return control valve 25 via a communication line 57.

The pressure chamber 41 of the regulating valve 37 is positioned within the control suction air line 49 at a location upstream of the valve chamber 48 of the air valve 38. The control suction air line 49 is formed with a pair of orifices 58, 59 arranged in series with the pressure chamber 41 intervening therebetween. The upstream orifice 58 has an aperture equal to or slightly smaller than that of the downstream orifice 59.

The second vacuum pressure line 32 is provided with an orifice 61 and a solenoid valve 62 arranged in series at a location upstream of the regulating valve 37. The solenoid valve 62 is controlled in response to an operative state of the engine, i.e., engine temperature, engine load, engine speed, etc., and is adapted to shut off the upstream side of the second vacuum pressure line 32 from the downstream side and allow the downstream side of the line 32 to communicate with the filterequipped atmospheric pressure inlet port 51, when its solenoid is in an energized state. In the illustrated embodiment, the solenoid valve 62 and the control suction air line 49 have the atmospheric pressure inlet port 51 in common, but two exclusive atmospheric pressure inlet ports may be provided for the valve 62 and the line 49 respectively.

The operation of the above-described embodiment will now be described. Let it now be assumed that the solenoids of the solenoid valves 33, 62 are in a de-energized state, that is, in the illustrated positions. When the vacuum pressure which is produced in the intake passage 15 in the vicinity of the throttle valve 17 is detected by the first vacuum pressure detecting port 21, the detected vacuum pressure Pc is transmitted to the vacuum pressure chamber 52 of the air valve 38 through the solenoid valve 33 and the orifice 34. When this vacuum pressure Pc exceeds the setting load of the valve spring 56, it causes the diaphragm 53 to lift the valve element 54 to open the control suction air line 49.

With the control suction air line 49 thus opened, atmospheric air is introduced into the line 49 through the atmospheric pressure inlet port 51 and fed into the intake passage 15 of the engine 10 through the valve chamber 48 and valve port 55 of the air valve 38, after having its flow rate restrained by the orifices 58, 59 located, respectively, upstream and downstream of the vacuum pressure chamber 41 of the regulating valve 37. Consequently, there occur vacuum pressures P1 and P2, respectively, in the pressure chamber 41 of the regulating valve 37 and the valve chamber 48 of the air valve 38, the ratio between the two vacuum pressures P1, P2 being determined by the ratio in aperture size between the orifices 58, 59.

When the lifting force of the diaphragm 42 which is produced due to the difference between the vacuum pressure P1 in the pressure chamber 41 and the vacuum pressure Pv detected by the second pressure detecting port 22 surpasses the setting load of the valve spring 46, the diaphragm 42 lifts the flat valve element 43 to open the valve port 44, whereby part of the vacuum pressure from port 22 passes through the valve port 44 to dilute the vacuum pressure previously passing through the orifice 34 to produce a vacuum pressure Pe which then acts upon the pressure chamber 29 of the return control valve 25, as acting pressure.

With the above vacuum pressure diluting system, a reduction in the acting vacuum pressure Pe is fed back to the pressure chamber 52 of the air valve 38 through the communication line 57 to cause a corresponding reduction in the vacuum pressure in the chamber 52, which in turn causes a decrease in the opening of the valve port 55 of the air valve 38. The resulting decrease in the flow rate of air passing in the control suction air line 49 causes the vacuum pressure P1 in the pressure chamber 41 and the vacuum pressure P2 in the valve chamber 48 to decrease while maintaining the ratio between the vacuum pressures P1 and P2 at a predetermined value determined by the orifices 58, 59, so that the flat valve element 43 closes the valve port 44. Upon the flat valve element 43 closing the valve port 44, there occurs an increase in the acting vacuum pressure Pe, which is then fed back to the air valve 38. Then, in a manner contrary to that mentioned above, the flat valve element 43 opens the valve port 44. This cycle of operation is repeated. This repetition of the cycle of operation takes place so quickly that the vacuum pressures Pv and Pe can be maintained in a predetermined fixed ratio to each other, which ratio is in proportion to the ratio between the vacuum pressures P1 and P2.

With the above system, when the flow rate of suction air being supplied to the engine 10 is so small that the vacuum pressure P1 is higher than the vacuum pressure Pv, the flat valve element 43 of the regulating valve 37 is biased toward its open position to make the acting vacuum pressure Pe less intense for the return control valve 25. When said suction air flow rate increases, the vacuum pressure Pv correspondingly increases to cause the flat valve element 43 to move toward its closed position to increase the acting vacuum pressure Pe. Since the air valve 37 and the return control valve 25 are operated by the same vacuum pressure Pe which thus varies in proportion to a change in the suction air flow rate, the flow rate of air flowing in the control suction air line 49 is proportional to the return rate of exhaust gas, and also the suction air flow rate is proportional to the return rate of exhaust gas. Therefore, the engine 10 is supplied with exhaust gas with a permanently constant exhaust gas return ratio. This exhaust gas return ratio is fixed by the ratio between the vacuum pressures Pv, Pe, that is, the aperture ratio between the orifices 58, 59.

When there is a need of reducing the above exhaust gas return ratio according to the operative state of the engine, the solenoid valve 62 is energized. More specifically, when the solenoid valve 62 is energized, the downstream side of the second pressure line 32 is placed in communication with the atmospheric pressure inlet port 51 as previously mentioned. Accordingly, the pressure in the valve chamber 39 of the regulating valve 37 is maintained at atmospheric pressure, with the flat valve element 43 biased in its open position so that the acting vacuum pressure Pe decreases in intensity to reduce the opening of the return control valve 25, thus reducing the exhaust gs return ratio.

When there occurs a need of interrupting the exhaust gas recirculation, the solenoid valve 33 is energized. More specifically, when the solenoid valve 33 is energized, the downstream side of the first pressure line 31 is placed in communicaton with the atmospheric pressure inlet port 35 as previously mentioned to make the acting vacuum pressure Pe equal to atmospheric pressure, so that the return control valve 25 is brought into its closed position, thus interrupting the exhaust gas recirculation.

Figure 2:
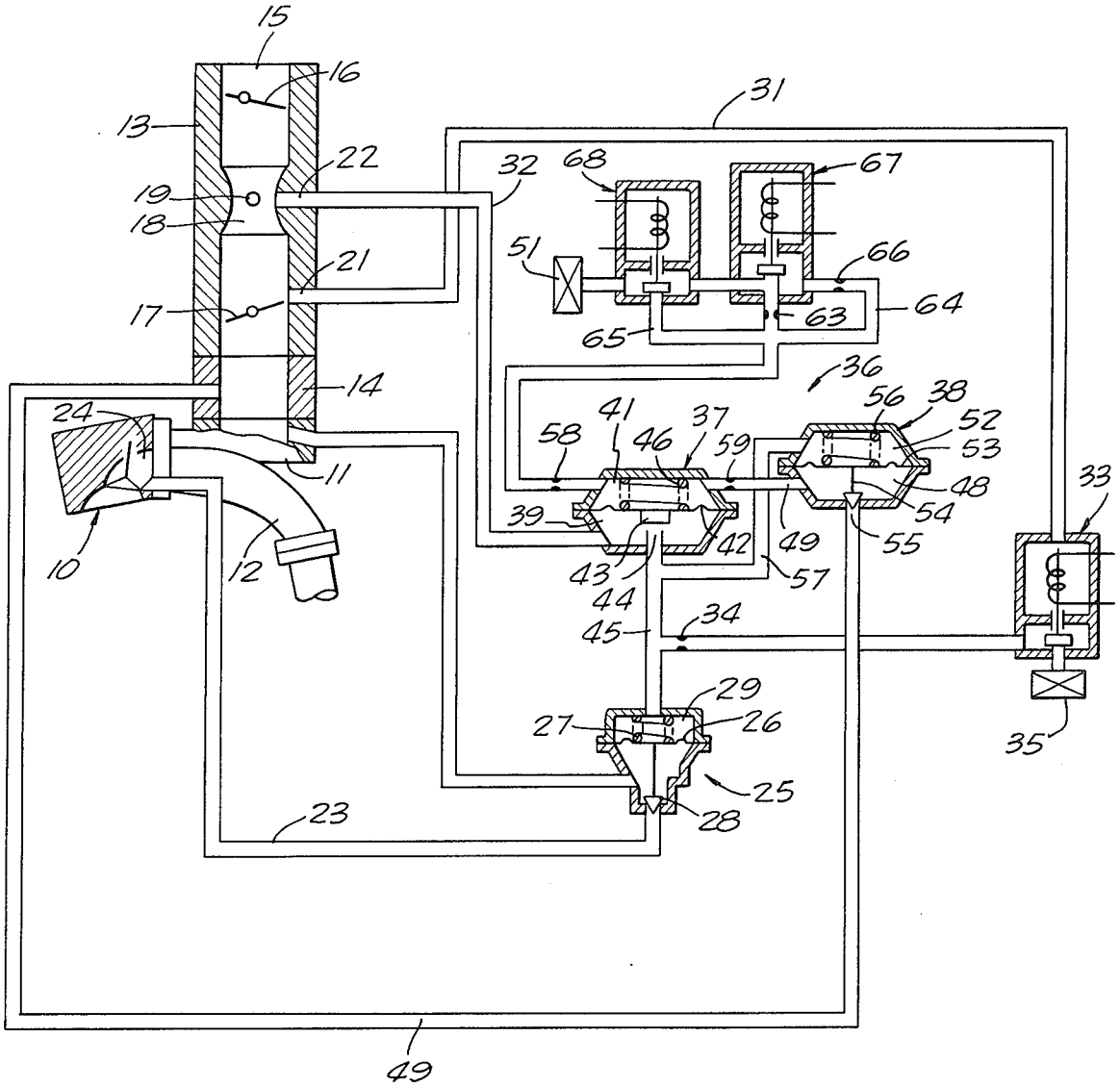
FIG. 2 is a similar view showing a modification.

FIG. 2 illustrates a second embodiment of the invention, which is different from the previously described embodiment in measures for adjusting the exhaust gas return ratio. The following description relates only to the parts of the present embodiment which are different from the previous embodiment: Orifices 58, 59 are provided in the control suction air line 49 on the upstream and downstream sides of the vacuum pressure chamber 41 of the regulating valve 37, similar to the construction of the previous embodiment. According to the present embodiment, a further orifice 63 is provided in the line 49 at a location between the orifice 58 and the atmospheric pressure intake port 51, while first and second by-pass lines 64, 65 are connected to the suction air line 49 to bypass the orifice 63. The first by-pass line 64 is provided with an orifice 66 and a normally-closed type solenoid valve 67 arranged in series across the line 64, while the second by-pass line 65 is provided with a normally-closed type solenoid valve 68 alone arranged across it. The orifices 58, 63, 66 have their apertures designed such that the aperture of the orifice 63 is smaller than that of the orifice 58, while the aperture of the orifice 66 is smaller than that of the orifice 63. Energization of the solenoid valves 67, 68 is controlled in accordance with the operative state of the engine 10. The other parts of the present embodiment are substantially identical in structure and arrangement with corresponding ones of the previous embodiment. In FIG. 2, parts corresponding to those in FIG. 1 are designated by identical reference numerals or symbols.

With the above arrangement, the flow resistance of the portion of the control suction air line 49 extending from the atmospheric pressure inlet port 51 to the orifice 58 has a maximum value due to the action of the orifice 63 when both of the solenoid valves 67, 68 are closed (de-energized). It has an intermediate value due to the action of the parallelarranged orifices 63, 66 when the solenoid valve 67 alone is opened (energized). It has a minimum value when the solenoid valve 68 is opened wherein neither of the orifices 63, 66 is effective. The above manner of change of flow resistance would substantially be equal to an arrangement in which the orifice 58 has its aperture adjustable in three steps. Thus, a change in flow resistance causes a change in the ratio between the vacuum pressures P1, P2, and therefore the ratio between the vacuum pressures Pv, Pe, thus leading to a corresponding change in the exhaust gas return ratio.

Figure 3:
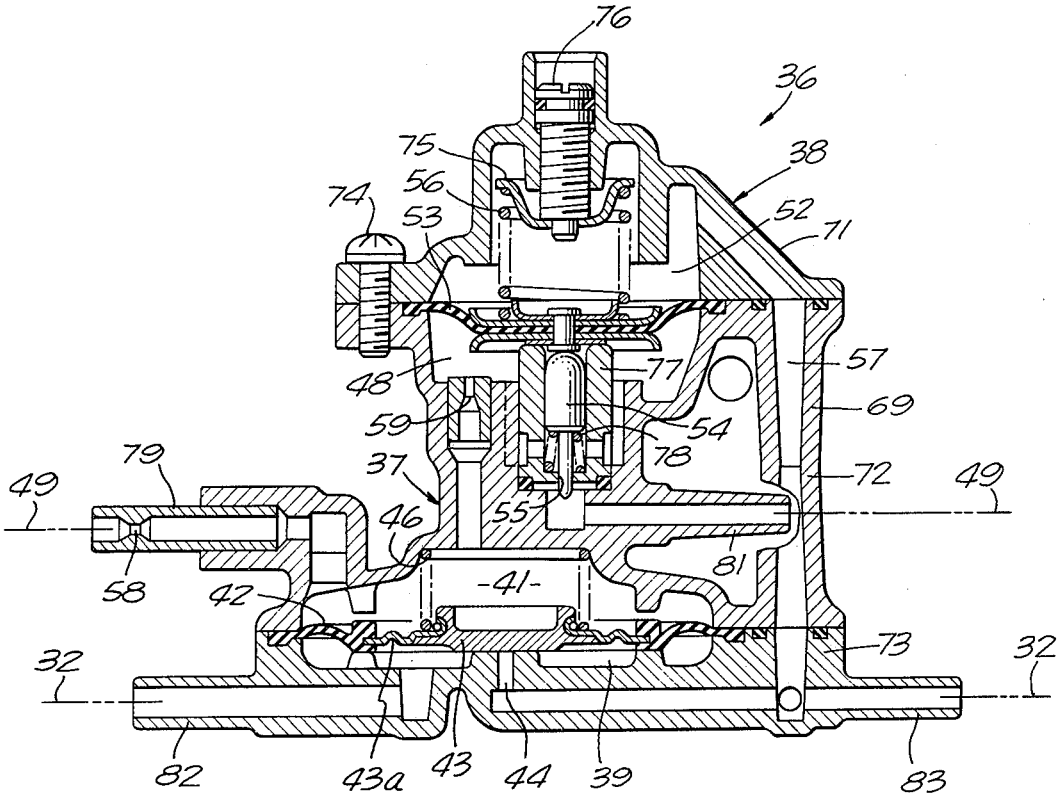
FIG. 3 is a sectional side elevation showing an actual device constructed in accordance with the diagram of FIG. 1.

FIG. 3 illustrates a concrete example of the pressure control valve 36 employed in the above-described embodiments. The valve casing 69 is formed of three discrete parts, that is, an upper element 71, an intermediate element 72 and a lower element 73, which are fastened together by means of bolts 74 and the like. The air valve 38 is formed between the upper element 71 and the intermediate element 72, and the regulating valve 37 between the intermediate element 72 and the lower element 73, respectively. In this manner, the two valves 37, 38 are fabricated in a unit.

More specifically, the air valve 38 has its diaphragm 53 held between the abutting surfaces of the upper element 71 and the intermediate element 72, the upper or vacuum pressure chamber 52 being formed within the upper element 71, and the lower or valve chamber 48 within the intermediate element 72, respectively. The valve spring 56 placed within the pressure chamber 52 in a taut state is supported at its upper end by a spring support plate 75 which in turn is supported by an adjusting screw 76 threadedly fitted in the upper element 71. With this arrangement, by rotating the adjusting screw 76 so as to move upward or downward the spring support plate 75, the setting load of the valve spring 56 can be adjusted. Fitted in the intermediate element 72 is a guide barrel 77 in which the valve element 54 is slidably fitted, which barrel 77 has its lower end portion formed with the valve port 55 which cooperates with the valve element 54. The valve element 54, though provided separately from the diaphragm 53, is permanently held in urging contact with the diaphragm 53 by the upward biasing force of a spring 78 which is much weaker than the valve spring 56. By separating the diaphragm 53 and the valve element 54, any axial or oblique vibrations of the diaphragm 53 would have no substantial influence upon the valve element 54, thus permitting positive opening and closing action of the valve element 54.

On the other hand, the diaphragm 42 of the regulating valve 37 has an annular configuration with its outer peripheral portion held between the abutting surfaces of the intermediate and lower elements 72, 73, and its inner peripheral portion joined to the flat valve element 43 via a reinforcing metal part 43*a*, by means of molding. The pressure chamber 41 on the upper side of the diaphragm 42 is formed within the intermediate element 72, the valve chamber 39 on the lower side of same within the lower element 73, and the valve port 44 which cooperates with the valve element 43 within the lower element 73, respectively. Fitted in the intermediate element 72 is a connection tube 79 having its interior formed with an orifice 58 and communicating with the vacuum pressure chamber 41. Further, the intermediate element 72 is formed integrally with another connection tube 81 communicating with the valve port 55. The connection tube 79 is connected to the upstream portion of the control suction air line 49, and the connection tube 81 to the downstream portion of same, respectively. Further, the intermediate element 72 is formed with part of the control suction air line 49 which establishes communication between the vacuum pressure chamber 41 and the valve chamber 48, within which is formed the orifice 59.

The lower element 73 is formed integrally with a connection tube 82 communicating with the valve chamber 39, as well as a connection tube 83 communicating with the valve port 44. The connection tube 82 is connected to the upstream portion of the second vacuum pressure line 32 and the connection tube 83 to the downstream portion of same, respectively. The communication line 57 connecting the valve port 44 with the vacuum pressure chamber 52 extends into all of the elements 71, 72, and 73.

As set forth above, according to the present invention, the recirculation valve 25 includes a first vacuum pressure line 31 extending from the suction passage 15 of the engine 10 at a zone in the vicinity of the throttle valve 17 or downstream thereof and connected to the vacuum pressure chamber 29 of the exhaust return control valve 25, a second vacuum pressure line extending from a certain vacuum pressure source and connected to the above vacuum pressure chamber 29, a vacuum pressure-actuatable regulating valve 37 connected to the second vacuum pressure line 32 for opening or closing same. The regulating valve 37 has its vacuum pressure chamber 41 arranged across a control suction air line 49 extending from the intake passage 15 of the engine 10 at a zone downstream of the throttle valve 17 to an atmospheric pressure inlet port 51. A vacuum pressure-actuatable air valve 38 is arranged across the control suction air line 49 at a zone downstream of the regulating valve, for opening or closing the same line 49, the vacuum pressure chamber 52 of the air valve 38 communicating with the vacuum pressure chamber 29 of the return control valve 25, wherein the control suction air line 49 is provided with at least one pair of orifices 58, 59 with the vacuum pressure chamber 41 of the regulating valve 37 intervening between them. This arrangement makes it possible to automatically control the opening of the return control valve 25 in response to the flow rate of air flowing in the control suction air line 49 so as to be proportional to the flow rate of suction air being supplied to the engine. Therefore, the return rate of exhaust gas can be proportional to the flow rate of suction air being supplied to the engine, thereby providing a desired exhaust gas return ratio.

In addition, a very simple operation which comprises selecting the aperture ratio between the pair of orifices 58, 59 enables setting the exhaust gas return ratio at any desired value. Thus, the invention can be applied to a variety of engines different in performance characteristics and operating factors. Also, the present system can be manufactured at low cost on a mass production basis. Further, by arranging the above pair of orifices 58, 59 so as to have their aperture ratio adjustable, it is possible to appropriately adjust the exhaust gas return ratio in accordance with the operative state of the engine, resulting in a reduction in the concentration of exhaust emissions, improved engine driveability, improved fuel consumption, etc.

Having fully described our invention, it is to be understood that we are not to be limited to the details herein set forth but that our invention is of the full scope of the appended claims.

We claim:

1. An exhaust gas recirculation control system for an internal combustion engine for a vehicle, the engine having an intake passage, an exhaust passage, and a recirculation passageway connecting said exhaust passages, the improvement comprising, in combination: a recirculation control valve in the passageway and having a vacuum pressure responsive actuator, a first conduit connecting the pressure responsive actuator with the intake passage, an air conduit connecting the intake passage downstream from a throttle valve therein to an inlet for atmospheric air, an air valve having a vacuum pressure chamber with a diaphragm and having a valve element secured to the diaphragm for opening or closing said air conduit, said vacuum pressure chamber of said air valve communicating with said pressure responsive actuator, a regulating valve having a vacuum pressure chamber and a valve chamber adjacent to said vacuum pressure chamber with a diaphragm intervening therebetween and a valve element secured to the diaphragm, said vacuum pressure chamber of said regulating valve being interposed in said air conduit upstream from said air valve, a second conduit connecting said valve chamber of said regulating valve with said intake passage upstream from the throttle valve, said valve element of said regulating valve controlling intensity of the vacuum pressure in said vacuum pressure responsive actuator and vacuum pressure in said vacuum pressure chamber of said air valve in response to differential pressure between pressures in both chambers of said regulating valve, and an electric-magnetic valve in said second conduit for opening or closing the second conduit in response to a sensor for an engine operating parameter.

2. An exhaust gas recirculation control system for an internal combustion engine for a vehicle, the engine having an intake passage, an exhaust passage, and a recirculation passageway connecting said exhaust passages, the improvement comprising, in combination: a recirculation control valve in the passageway and having a vacuum pressure responsive actuator, a first conduit connecting the pressure responsive actuator with the intake passage, an air conduit connecting the intake passage downstream from a throttle valve therein to an inlet for atmospheric air, an air valve having a vacuum pressure chamber with a diaphragm and having a valve element secured to the diaphragm for opening or closing said air conduit, said vacuum pressure chamber of said air valve communicating with said pressure responsive actuator, a regulating valve having a vacuum pressure chamber and a valve chamber adjacent to said vacuum pressure chamber with a diaphragm intervening therebetween and a valve element secured to the diaphragm, said vacuum pressure chamber of said regulating valve being interposed in said air conduit upstream from said air valve, a second conduit connecting said valve chamber of said regulating valve with said intake passage upstream from the throttle valve, said valve element of said regulating valve controlling intensity of the vacuum pressure in said vacuum pressure responsive actuator and vacuum pressure in said vacuum pressure chamber of said air valve in response to differential pressure between pressures in both chambers of said regulating valve, first orifice means provided in said air conduit upstream from said regulating valve and second orifice means provided in said air conduit between said regulating valve and said air valve, said second orifice means comprising plural orifices and branched air conduits having at least one orifice, and an electric-magnetic valve in the branched air conduit for opening or closing the branched air conduit in response to a sensor for an engine operating parameter.

* * * * *